US005763998A

United States Patent [19]

Colombo et al.

[11] Patent Number: 5,763,998

[45] Date of Patent: Jun. 9, 1998

[54] FIELD EMISSION DISPLAY ARRANGEMENT WITH IMPROVED VACUUM CONTROL

[75] Inventors: Paul Colombo, White Bear Lake; James E. Tolan, Edina; Kevin J. Hubbard, Stillwater, all of Minn.

[73] Assignee: Chorus Corporation, White Bear Lake, Minn.

[21] Appl. No.: 528,200

[22] Filed: Sep. 14, 1995

[51] Int. Cl.[6] ..... H01J 7/18

[52] U.S. Cl. ..... 313/495; 313/309; 313/549; 313/560

[58] Field of Search ..... 313/495, 309, 313/336, 351, 345, 549, 553, 560; 445/41, 53

[56] References Cited

U.S. PATENT DOCUMENTS

| | | | |
|---|---|---|---|
| 4,940,916 | 7/1990 | Borel et al. . | |
| 5,015,912 | 5/1991 | Spindt . | |
| 5,063,323 | 11/1991 | Longo et al. . | |
| 5,083,958 | 1/1992 | Longo et al. . | |
| 5,181,874 | 1/1993 | Sokolich et al. . | |
| 5,194,780 | 3/1993 | Meyer . | |
| 5,209,687 | 5/1993 | Konishi . | |
| 5,210,462 | 5/1993 | Konishi . | |
| 5,223,766 | 6/1993 | Nakayama et al. . | |
| 5,244,427 | 9/1993 | Umeya . | |
| 5,247,133 | 9/1993 | Wiemann . | |
| 5,329,207 | 7/1994 | Cathey et al. . | |
| 5,347,292 | 9/1994 | Ge et al. . | |
| 5,374,868 | 12/1994 | Tjaden et al. . | |
| 5,391,259 | 2/1995 | Cathey et al. . | |
| 5,397,958 | 3/1995 | Na | 313/481 |
| 5,413,513 | 5/1995 | Horne et al. . | |
| 5,438,240 | 8/1995 | Cathey et al. . | |
| 5,525,861 | 6/1996 | Banno et al. | 373/495 |
| 5,537,738 | 7/1996 | Cathey et al. | 29/830 |

OTHER PUBLICATIONS

"Production and control of vacuum in field emission flat panel displays," Paul H. Holloway et al.; *Solid State Technology* Aug. 1995, pp. 47–54.

"Surface–science aspects of vacuum microelectrics," P. R. Schwoebel et al.; *J. Vac. Sci. Technol. B*, vol. 13, No. 4, Jul./Aug. 1995.

"Flat panel display prototype using low–voltage carbon field emitters," A. Y. Tcherepanov et al.; *J. Vac. Sci. Technol. B*, vol. 13, No. 2, Mar./Apr. 1995.

"The field–emitter display," Henry F. Gray; *Information Display*, Mar. 1993, pp. 9–14.

"Update on flat panel displays," William O'Mara; *Solid–State Technology*, Nov. 1993, pp. 35–41.

"Beyond AMLCDs: Field emission displays?," Katherine Derbyshire; *Solid State Technology*, Nov. 1994, pp. 55–65.

"Glass," David C. Boyd and David A. Thompson; *Kirk–Othmer: Encyclopedia of Chemnical Technology*, vol. 11, 3d Ed., pp. 816–880.

"Organic emitters promise a new generation of displays," Stephen R. Forrest et al.; *Laser Focus World*, Feb. 1995, pp. 99–107.

(List continued on next page.)

*Primary Examiner*—Sandra L. O'Shea
*Assistant Examiner*—Vip Patel
*Attorney, Agent, or Firm*—Merchant, Gould, Smith, Edell, Welter & Schmidt, P.A.

[57] ABSTRACT

A method of manufacturing a tri-plate vacuum-sealed field emission type display facilitates mass production ex-situ. The method is based on a plate including an anode plate, a backing plate including at least one sealed access orifice, and a cathode/substrate plate secured between the anode plate and the backing plate. The cathode/substrate plate is vented in the active area, with a multitude of pass-through apertures, each aperture being conically shaped to optimize uninterrupted travel of damaging gas molecules to a getter located on the opposite side. Before sealing the access orifice in the backing plate, the orifice is used to decontaminate the inside of the display with a cleaning gas and to insert a granule form of getter.

12 Claims, 7 Drawing Sheets

OTHER PUBLICATIONS

"Flat–panel displays benefit from laser processing," Diana R. Zankowsky; *Laser Focus World,* Mar. 1994, pp. 139–141.
"Diamond–based field emission flat panel displays," Nalin Kumar et al.; *Solid State Technology,* May 1995, pp. 71–74.
"Can micromachining deliver?," Louis C. Vintro; *Solid State Technology,* Apr. 1995, pp. 57–61.
"Europe's Flat Panel Display Industry is Born," Brian Dance; *Semiconductor International,* Jun. 1995, pp. 151–156.
"Robotics in automated process tools for the FPD fab," James Cameron; *Solid State Technology,* Jun. 1995, pp. 87–91.
"MCC and SI Diamond Sign Agreement for Flat Panel Display Development," *McCollaborations* (undated), pp. 23–25.
"A revolution is in store for flat–panel displays," Jack Shandle; reprinted from *Electronic Design,* Apr. 1993.
W. D. Kingery, et al., *Introduction to Ceramics,* John Wiley & Sons, 1976; p. 365.
Texas Instruments, Inc. –specs for flat panel display (??), Aug. 9, 1995.
"The grand alliance in flat panels," Gail Edmondson et al.; *Business Week,* Aug. 28, 1995, pp. 73–74.
Brochure: "St 707™ Non–evaporable getters activatable at low temperatures," *Saes Getters S.p.A.,* Apr. 1987.
"IVMC '95 – Eighth International Vacuum Microelectronics Conference – Technical Digest," *Electron Devices Society* and *IEEE,* Portland, Oregon, Jul. 30–Aug. 3, 1995.

FIELD EMISSION DISPLAY ARRANGEMENT WITH IMPROVED VACUUM CONTROL

FIELD OF THE INVENTION

The present invention relates generally to field emission displays, such as those used in flat panel display applications. More particularly, the present invention relates to the construction, processing operation and manufacturability of flat displays using field emission technology.

BACKGROUND OF THE INVENTION

In recent years there have been significant efforts in researching and developing arrangements and techniques to produce practicable flat panel displays. Such displays are presently being used in a variety of applications, including home theater, hand-held video games, and notebook and lap-top computers.

There are at least four competing technologies in the flat panel display area. They are: liquid crystal, plasma, electroluminescent phosphor, and field emission. Liquid crystal display arrangements use crystals to either block light or let it shine through. The plasma display uses common florescent light principles in its operation. The electroluminescent phosphor display is characterized by electroluminescent phosphors being sandwiched within a grid of wires. The emission display (FED) technology, which is discussed below relative to the present invention, has thus far been limited in terms of operation and manufacturability to relatively small-size displays.

Field emission display technology usually involves a display screen plate (or anode plate) having a multitude of phosphor pixels to provide images for display, a cathode plate carrying electron-firing microtips which are aligned with the phosphor pixels, and a vacuum created between the plates to allow electron transfer from the cathode plate to the anode plate. Each microtip, or set of microtips, is controlled by an electronic circuit, which includes a matrix-type connection to the cathode plate, for activating the firing or emission of the electrons toward the phosphor carrying display screen. This arrangement is contained in a sealed vacuum in an attempt to optimize screen intensity and to increase the life of the display. Despite the existence of the sealed vacuum, gas molecules will permeate (or leak) into the vacuum enclosure, thereby causing degradation of both display intensity and screen longevity. The degradation of the vacuum can also be caused by, in particular, gas molecules emanating from the phosphor side (anode side) of the display screen. To address this problem, an additional material, getter, which has the known property of permanently absorbing these gas molecules, is placed on or near the cathode plate. One such getter which can be used for this purpose is the ST 707, as described in "Non-evaporable Getters Activatable At Low Temperatures", Saes Getters S.p.A., Via Gallarate 215, Milano 20151, Italy.

The use of the getter is important for offsetting the damaging gas molecules in two contexts, system start-up and steady-state operation.

At start-up, due to imperfections in the manufacturing process, there can be an abnormally large number of damaging gas molecules generated by the phosphor-carrying display screen as well as other contaminated components making up the FED arrangement. This problem can be overcome by using a large amount of getter, or by taking extraordinary and expensive pre-assembly measures to prevent such contamination of the FED structure. Due to the gravity of the start-up problem, typical constructions involve using both large amounts of getter and an in-vacuum, clean-room manufacturing process which is expensive and slow.

The steady state effectiveness of the getter is important to maintain a suitable vacuum level. After start-up, which is after the getter has already been partially depleted due to the start-up effect, the getter must sustain the vacuum level for the life of the product to prevent damage (known as "voltage breakdown") of the cathode-located electrode microtips. To this end, sufficient amounts of getter are strategically placed on or around the cathode plate to quickly absorb these molecules before they bring about damage. Insufficient getter or significant delay in the travel time from the central portions of the display screen to the getter can result in such destruction. This, in turn, results in grossly deficient display sections. The likelihood of such damage to the microtips over time increases with every incremental increase in the size of the display screen.

Accordingly, the flat panel display is ideally constructed with sufficient getter strategically placed to avoid these problems. In this way, the gas molecules permeating into the display and, emanating from the display, can be quickly captured and absorbed by the getter. For small displays, the short distance between the central portions of the display and the getter allows reasonable pumping speed so that the gas molecules are absorbed before any significant damage occurs to the electrode microtips. For larger displays, however, it is extremely difficult to construct the display cost-efficiently and in large quantities in such a way to prevent damage to the surfaces of the electrode microtips. For example, by locating the getter around the outside of the cathode plate (surrounding the electrode microtip array), a group of gas molecules emanating from the central portions of the display screen will likely interact with numerous electrode microtip surfaces before finally reaching the getter. Conversely, if the getter was positioned within the central portions of the cathode plate, it will block microtips and create dark areas within the screen. This would be highly unacceptable and irritating for most flat panel display applications. In addition, the metallic nature of most getter could cause destructive electrical shorting between the anode and the cathode. Even in known vented cathode plate structures, where the gas molecules are permitted to pass though the cathode plate to a large amount of getter, the requisite size and quantity of the vents in the cathode plate unacceptably displace would-be microtips and create dark areas within the screen.

In this manner, there exists a tension between the goals of (1) maximizing the quantity and distribution of getter to achieve adequate pumping speeds within the display in order to protect the electrode microtips from damage, and (2) maximizing the quantity and distribution of the electrode microtips to create a homogeneous display output. Some degree of realization of both goals is necessary for effective display quality, especially for large-screen applications. However, in the known prior art, both goals have not been realized to any high-level of degree. These problems have been recognized as significant and attempts to overcome them have been in adequate. For further discussion of these problems and some of the attempt to overcome them, reference may be made to: U.S. Pat. Nos. 5,038,958 (Longo), 5,223,776 (Nakayama) and 5,247,133 (Weimann); P. R. Schwoebel and I. Brodie: "Surface-science Aspects of Vacuum Microelectronics," pp. 1392–1393, *J. Vac. Sci. Technol. B*, Vol. 13, No. 4, July/August 1995; and P. H. Hollaway, J. Sebastian, T. Trottier, H. Swart, and R. O. Peterson: "Production and Control of Vacuum in Field Emission Flat panel Displays," Solid State Technology, August 1995, pp. 4751.

In the relatively large display applications, it is especially important to increase the molecule-absorbing capacity of the getter and to increase the speed at which the getter absorbs the molecules after they are initially generated. The capacity of the getter is an important factor, because a large screen requires an anode (phosphor) plate of a corresponding size that can deplete the getter on start-up, if the capacity of the getter is insufficient. The pumping speed is also important, because the large anode plate will generate damaging gas molecules continuously from all areas of the plate.

Another difficulty in such large display applications is the goal of reducing the emission current by narrowing the distance between the cathode plate and the phosphor carrying display screen (also known as the anode plate). As the emission current is reduced by arranging these plates closer together, the pumping speed (or responsiveness) of the getter further decreases. For these and other technical reasons and limitations, implementing known field emission display arrangements in large scale applications, or in high volume low-cost applications, has been impracticable.

Accordingly, there is a need for an improved arrangement of implementing and manufacturing field emission displays. The present invention provides an alternative arrangement and method to overcome the above-mentioned deficiencies and other problems, and provides significant advantages over the prior art structures and techniques.

SUMMARY OF THE INVENTION

An exemplary embodiment of the present invention is directed to a field emission display arrangement and method of manufacturing the arrangement. The arrangement includes an anode plate having pixels for displaying images, a backing structure, a substrate plate secured between the anode plate and the backing structure, a circuit having electron-emitters directed toward the anode plate and secured to one side of the substrate plate, a pump means arranged between the backing structure and the substrate plate for permanently absorbing gas molecules generated within the display. The substrate plate includes a multitude of pass-through apertures, each aperture surrounded by at least one side wall having a first section adjacent the circuit and defining a first cross-sectional area and having a second section adjacent the first section and defining a second cross-sectional area that is substantially greater than the first cross-sectional area.

The above summarizes various aspects of particular embodiments incorporating principles of the present invention. This summary discussion is not intended to summarize or describe each embodiment or every feature of the present invention.

BRIEF DESCRIPTION OF THE DRAWINGS

Other aspects and advantages of the present invention may become apparent upon reading the following detailed description and upon reference to the drawings in which.

Figure 1:
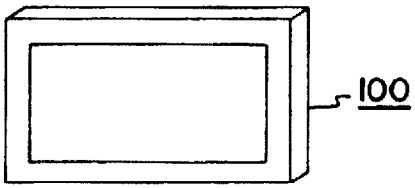
FIG. 1 perspective view of a flat panel display product, which exemplifies an application incorporating the principles of the present invention.

While the invention is susceptible to various modifications and alternate forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

The present invention has a variety of applications in field-emission display products and processes requiring or benefitting from the inventive principles illustrated and described in connection with the figures. The perspective diagram shown in FIG. 1 illustrates such a display embodying the present invention. The display product 100 of FIG. 1 is representative of multiple types of products using this field emission technology, in accordance with the principles of the present invention. For example, at the larger end of the spectrum, the display 100 represents a wall-mounted field emission display for home theater use, while at the smaller end of the spectrum, the display 100 represents a miniature display for a video wrist-watch. As will be discussed below, the principles of the present invention do not limit its application. However, the present invention has been found to be highly advantageous for mass-producing any size display and specially advantageous for mass-producing such displays having larger screens.

Figure 2:
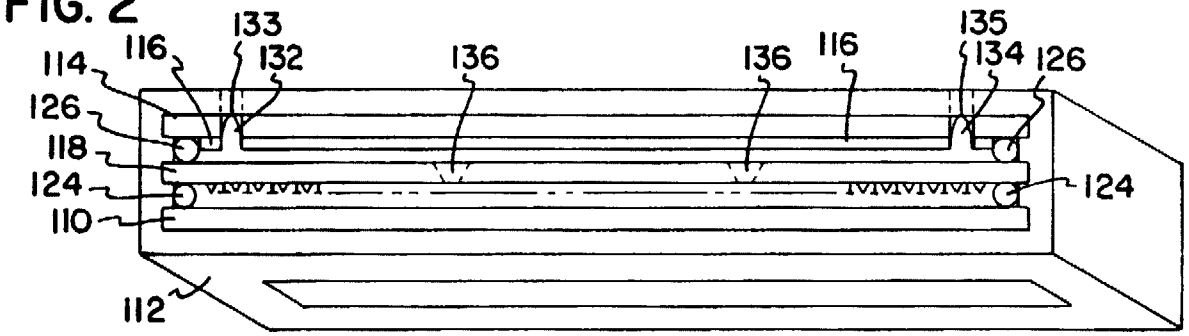
FIG. 2 is a diagram showing an exploded perspective view of a portion of a field emission display screen, as exemplified in FIG. 1 and also in accordance with the principles of the present invention, with certain internal sections of the arrangement shown via transparent imaging.
Figure 3A:
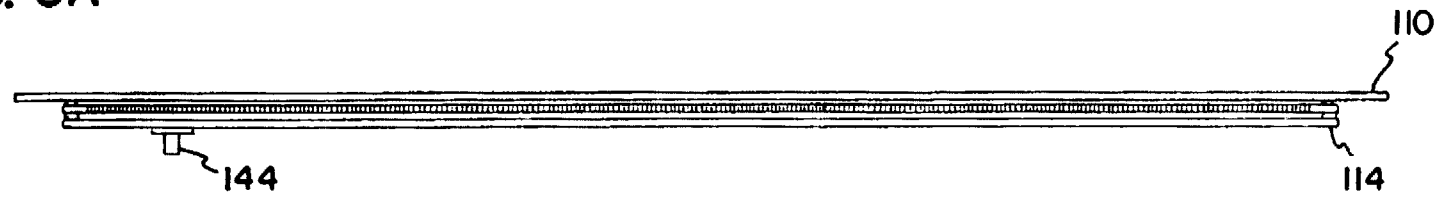
FIG. 3 is an exploded, cross-sectional view of the field emission display construction shown in FIGS. 1 and 2.
Figure 3B:
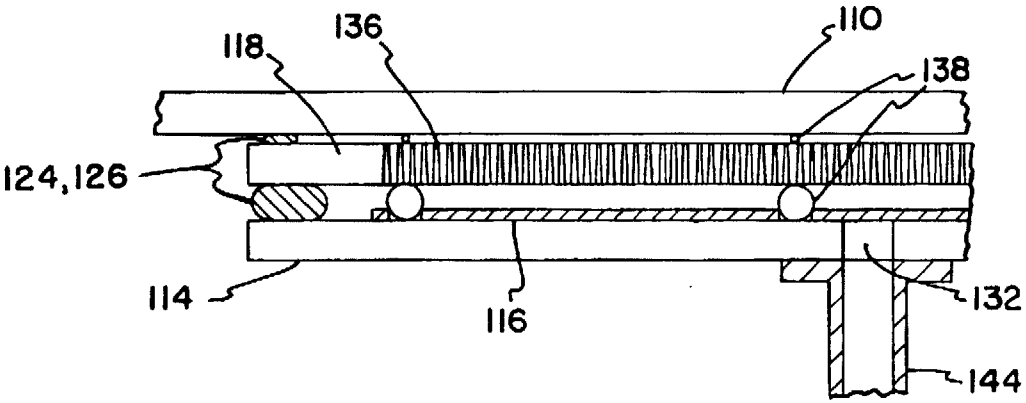

In FIGS. 2 and 3, the screen portion of the product of FIG. 1 is shown in exploded form, with certain internal sections of the arrangement shown via transparent imaging. FIG. 2 shows a perspective, top view of the screen portion of the product with the top portion thereof removed. FIG. 3 shows a side, cross-sectional view of the screen portion.

As implemented in these figures, the display includes three plates and two seals. An anode plate 110 having phosphor-pixels for displaying screen images is contained by the display housing 112. Opposite the anode plate 110, and also supported in the housing 112, is a backing structure, or plate, 114. The backing plate 114 is virtually covered with a pump mechanism (e.g., a getter) 116 for permanently absorbing gas molecules generated within the display. Acceptable types of molecule-absorbing pump mechanisms include getters (evaporable, non-evaporable, granulated or solid), ion pumps and other chemical pump or mechanical pump means. The center plate is a specially vented cathode plate 118, which includes a vented substrate plate and a circuit having electron-emitters directed toward the anode plate and secured to one side of substrate plate.

These plates are sealed to one another using a first ring-like seal 124 and a second ring-like seal 126. The first ring-like seal 124 seals the outer periphery of the opposing surfaces of the anode plate 110 and the cathode plate 118. The second ring-like seal 126 seals the outer periphery of the opposing surfaces of the backing plate 114 and the cathode plate 118. These seals 124 and 126 are used in conjunction with specially arranged apertures 136 in the cathode plate 118 to provide a single vacuum between the anode plate 110 and backing plate 114, which is sealed on the edges by the seals 124 and 126. Spacers 138 are used to maintain rigidity and proper separation between the respectively arranged plates 100, 118 and 114.

Another important aspect of the present invention involves minimizing depletion of the pump mechanism 116 at start-up. The tri-plate, dual-seal structure of FIG. 2 is treated after assembly and before vacuum-sealing to minimize contamination. This is significant, because the process permits mass production of the display in an environment which is virtually the same as assembling the parts of the display in a vacuum environment. As discussed further in connection with FIGS. 8*a*–8*e*, an inlet attachment 144 is used in the manufacturing process to supply decontaminating (or cleaning) gas(es) through a sleeved access orifice (or inlet) 134 to the inside of the display. The gas, for example, an inert gas or hydrogen, is used to fill the inside area of the display to minimize contamination, thereby minimizing microtip damage at start up. A similarly constructed outlet attachment (FIGS. 8*a*–8*e*) is used for drawing the supplied gas(es) out of the display through another sleeved access orifice (or outlet) 132. As discussed in connection with FIGS. 8*a*–8*e*, the sleeves are closed, as depicted at 133 and 135, after access is completed.

Figure 4A:
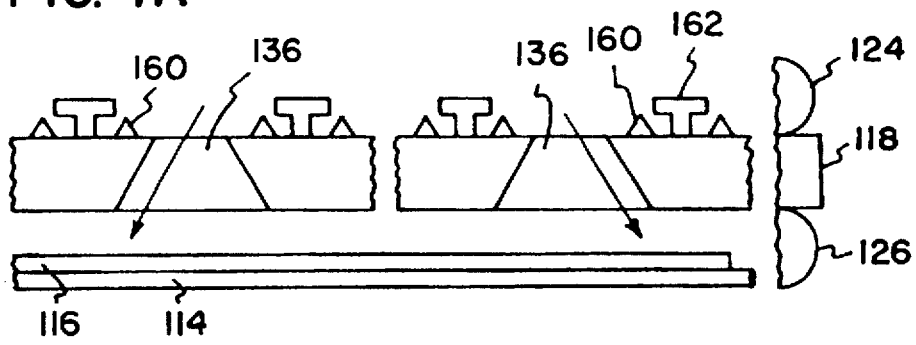
FIG. 4*a* is a further exploded view of a portion of the structure shown in FIG. 3.

FIG. 4*a* provides a more detailed view of the cathode plate 118, which is illustrated to include both the substrate having the specially configured apertures 136 therethrough and a conventional electron-emitting circuit.

The apertures 136 are another important aspect of the present invention, because they are shaped and located to significantly contribute to the level of pumping speed (from the anode plate to the getter on the back plate) needed to overcome the gas-discharge problem upon start-up. Discharged gas molecules directed at a surface most often reflect in a direction that is normal to the surface and are sometimes reflected backward from the surface. To minimize the likelihood that the gas molecules are reflected from the wall(s) of the recess and back to the area where damage to the microtips can occur, the apertures 136 are shaped to minimize, or remove, the likelihood of contacting the side walls surrounding the apertures. While different shapes may be used for the apertures, for example, multi-sided tapered (or stepped) walls, a conical shape is preferred. Ideally, the conical shape has an opening angle sufficient to permit uninterrupted gas molecules from the outermost regions of the anode plate.

The electron-emitting circuit is exemplified in FIG. 4*a* as a triode-type electron emission circuit employing cone-shaped emitters 160 and the insulator-gate structures 162 between the emitters 160. Alternatively, a conventional diode-type electron emission circuit such as referenced, for example, in "Diamond-based Field Emission Flat Panel Displays", Kumar, Solid State Technology, May 1995. In either embodiment, the electron emission circuit (which can be mounted on a plate-adhering carrier) is surrounded by the outer peripheral seal 124.

Figure 4B:
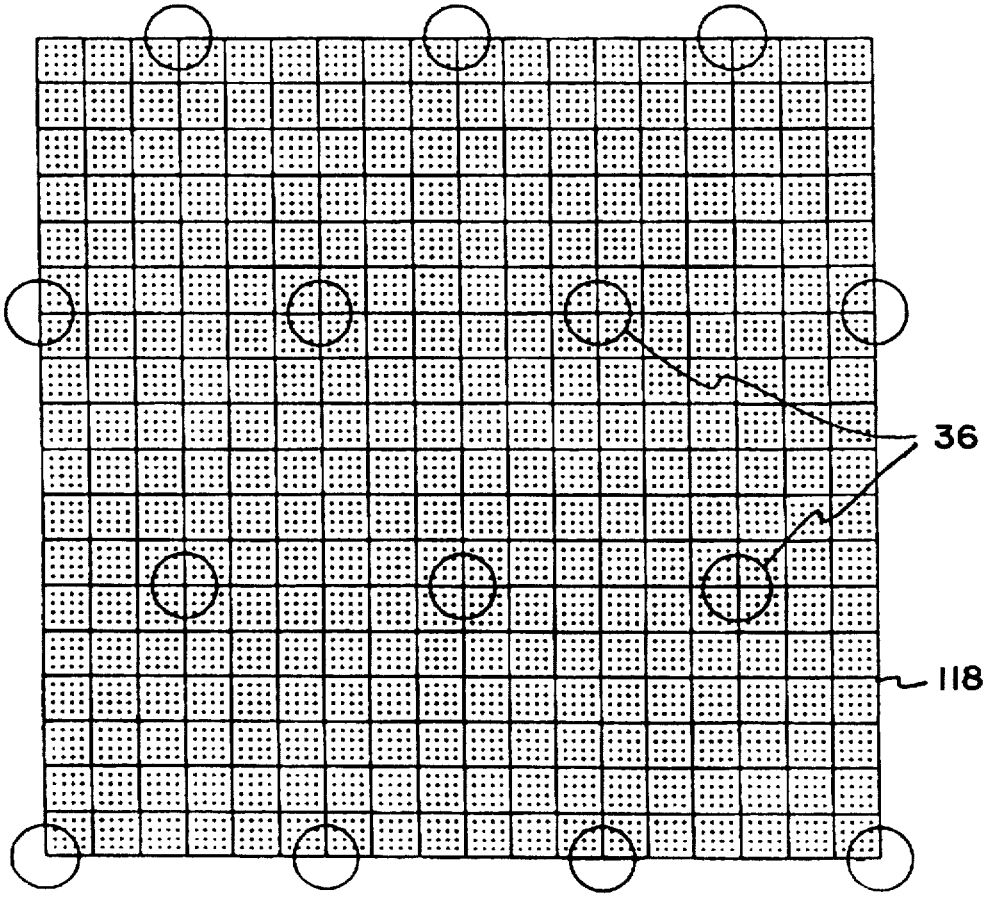
FIG. 4*b* is an exploded top view of a portion of the structure shown in FIG. 3.

FIG. 4*b* illustrates a top view of the substrate plate 118 shown in FIG. 4*a*. While different display applications require different concentrations of the apertures 136, they are shown occupying less than about 10–12 percent of the active area of the plate 118, with the apertures 136 having a diameter of about 20–75 microns and with the microtips 160 shown gathered in pixel groups of sixteen per pixel. Any of a number of offset-row (or triangular) arrangements of the apertures can be used, as exemplified in FIG. 4*b*, to strategically locate the apertures with respect to the colored (red, green and blue) sub-pixels to maintain equal color intensity. Each aperture 136 is located opposite each pixel (set). This is important, because it permits the average of the sub-pixels to project at the same intensity. Further, when manufacturing this structure with the process described in connection with FIGS. 8*a*–8*e*, the location of these apertures 136 can also be used to align the plate 118 with a reference point placed at a pixel group on the anode plate.

Figure 5A:
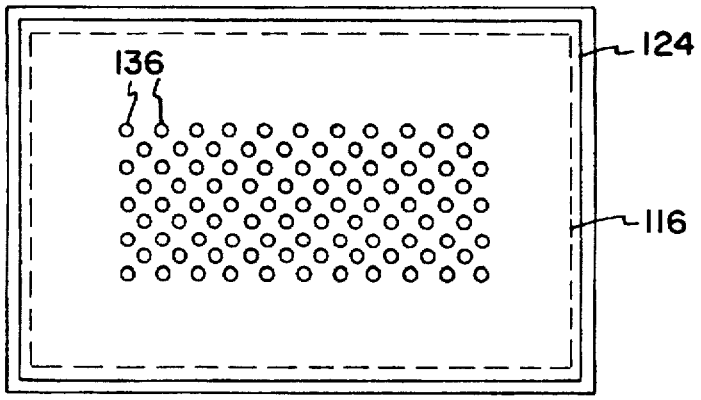
FIG. 5*a* is a top view of a perforated substrate plate, as illustrated from a side view in FIG. 4*a;*

FIG. 5*a* illustrates a top view of the aperture-plate arrangement of FIG. 4*b*, with the periphery seal 124 surrounding the apertures 136. The getter 116 is depicted by dotted lines as being located underneath the plate 118, and extending outwardly past the apertures 136. In a similar view, an alternative embodiment 118' of the aperture-plate arrangement of FIG. 4*b* is shown with elongated slots 170 (which can also be implemented as two series of slots) along two sides of the periphery seal 124 and outside of the active area. With the matrix of conductors 176 conventionally arranged and controlled from two adjacent sides of the plate 118', the combined pass-through effect of the slots 170 and the apertures 136 (FIG. 5*a*) is significantly more than the arrangement provided in FIG. 5*a*.

Figure 5B:
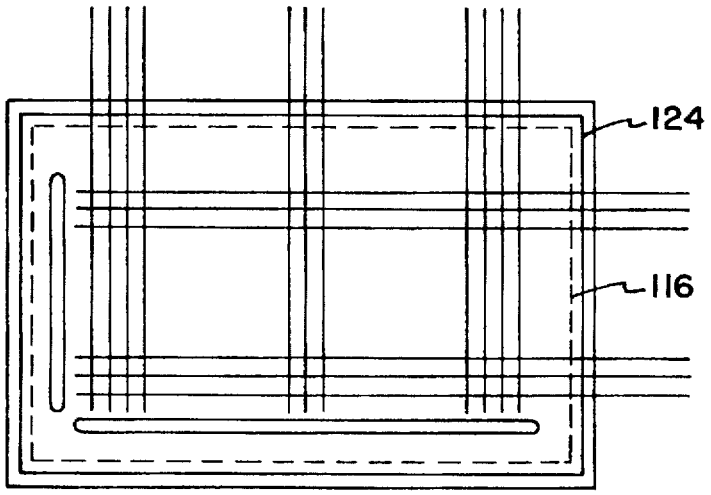
FIG. 5*b* is a top view of another perforated substrate plate, also constructed in accordance with the present invention, which may be used as an alternative to the substrate plate shown in FIG. 5*a;*
Figure 6:
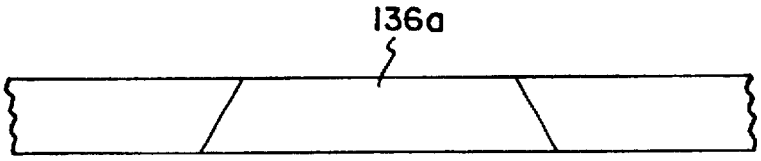
FIG. 6 is an exploded side view of another perforated substrate plate, also constructed in accordance with the present invention, which may be used an alternative to the substrate plate shown in the previous figures.
Figure 7:
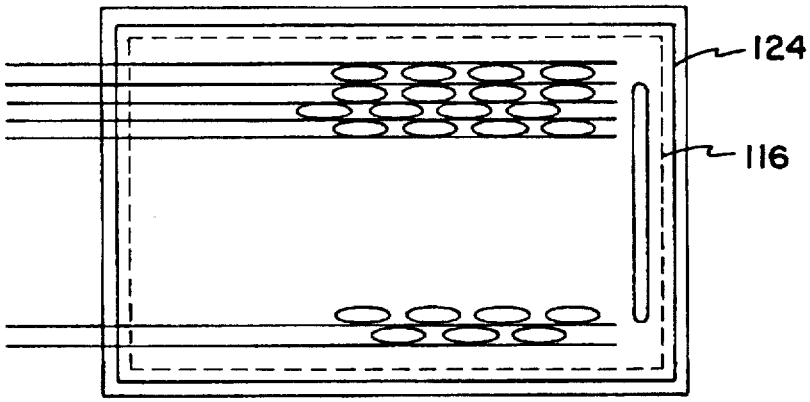
FIG. 7 is a top view of the perforated substrate plate illustrated from a side view in FIG. 6.

FIGS. 6 and 7 show yet another alternative aperture-plate arrangement, which may be used for a diode-type electron emission circuit. The diode-type electron emission circuit uses only a row of conductors, as compared to the matrix of conductors shown in FIG. 5*b*. To increase the pass-through effectiveness of the vented cathode plate, the embodiment of FIGS. 6 and 7 includes elongated apertures 136*a*. FIG. 6 illustrates a cut-away perspective of the plate 118". FIG. 7 illustrates an arrangement of these apertures between emission-controlling conductors 182, and with elongated slot(s) 182 in the nonactive edge areas of the plate 118".

Referring now to FIGS. 8*a*–8*e*, an exemplary way of manufacturing the arrangement of FIG. 3 is shown through a series of assemblies. FIGS. 8*a*–8*e* depicts a front view of the lower portion of a sealing fixture 210 having controlled heating elements 214 extending through the length (into the page) of the sealing fixture 210.

Figure 8A:
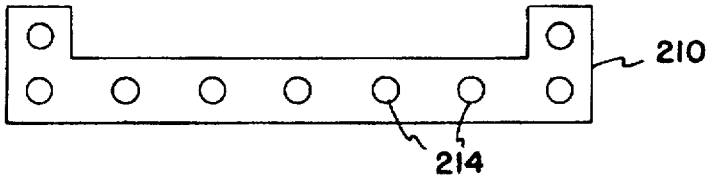
FIGS. 8*a*–8*e* comprise a series of assemblies, according to the present invention, which illustrate an exemplary methodology of manufacturing and assembling the display device of FIG. 2.
Figure 8B:
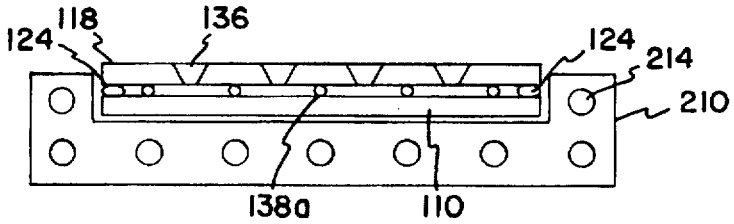
Figure 8C:
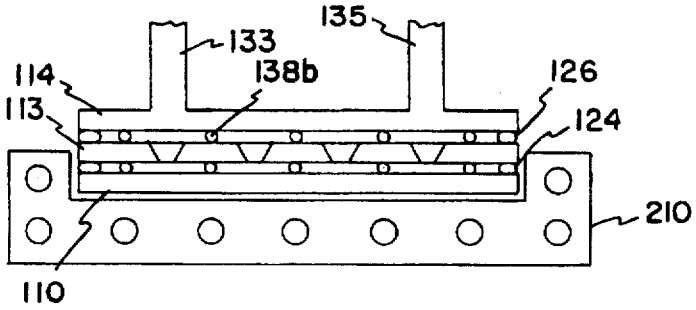

In FIG. 8*b*, the sealing fixture 210 shown receiving first the anode plate 110, the periphery seal 124 and the spacers 138*a* and then the vented cathode plate 118. The anode plate 110, the seal 124 (and 126) and the spacers 138*a* (and 138*b* of FIG. 8*c*) are conventional, except for an alignment tag (or tags) placed on the cathode side of the anode plate 110 for laser alignment through one (or more) of the apertures 136. The substrate portion of the cathode plate 118 is preferably a photo-sensitive glass, such as "Photoform"(available from Corning Inc.).

This portion of the cathode plate 118 can be manufactured by melting and forming a silicon-based (or $SIO_2$-based) compound into a plate with the desired shape defining the plates edges and with the desired plate thickness (e.g., about 1.1 millimeters). An acceptable silicon-based (or $SIO_2$-based) compound has the following composition: $SIO_2$ 79.8%, $LI_2O$ 9.4%, $K_2O$ 4.0%, $AI_2O_3$ 3.9%, $Na_2O$ 1.5%, ZnO 1.0%, $Sb_2O_3$ 0.4%, $CeO_2$ 0.012%, Ag 0.12%, and Au 0.001%. Once the substrate portion of the plate 118 has been formed, a mask is placed on the getter side of the plate in all areas except for the designated locations for the apertures 136. Next, the masked side of the plate is exposed to an ultraviolet light. Use of the photosensitive plate is advantageous because the ultraviolet light provides a degree of crystallization to the exposed portions, thereby providing a more soluble region for etching. Heat is then applied, followed by the application of an acid to the exposed portions of the plate. The acid is used for etching the plate with the conically tapered apertures 136, with the advantage that no additional forming is required. The intensity of the etching process is controlled, so that the apertures are sized and arranged as discussed in connection with FIG. **4*b***. The plate then is fired a second time to crystallize the plate for strength. For additional information concerning this etching process, reference may be made to p.365 of an article entitled "Glass", by David C. Boyd and David A. Thompson, a publicaton of Corning Inc. (reprinted from Kirk-Othmer: Encyclopedia of Chemical Technology, Vol. 11, Third Ed., pp. 807–880, John Wiley & Sons, Inc., 1980.

Next, the electron emission circuit is applied using conventional techniques to provide the finished cathode plate 118.

Figure 8D:
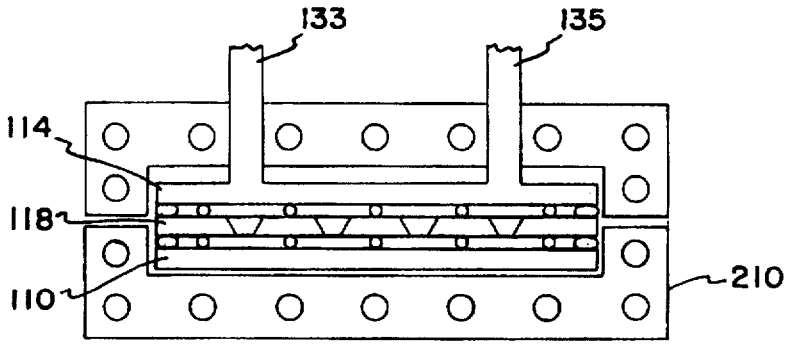
Figure 8E:
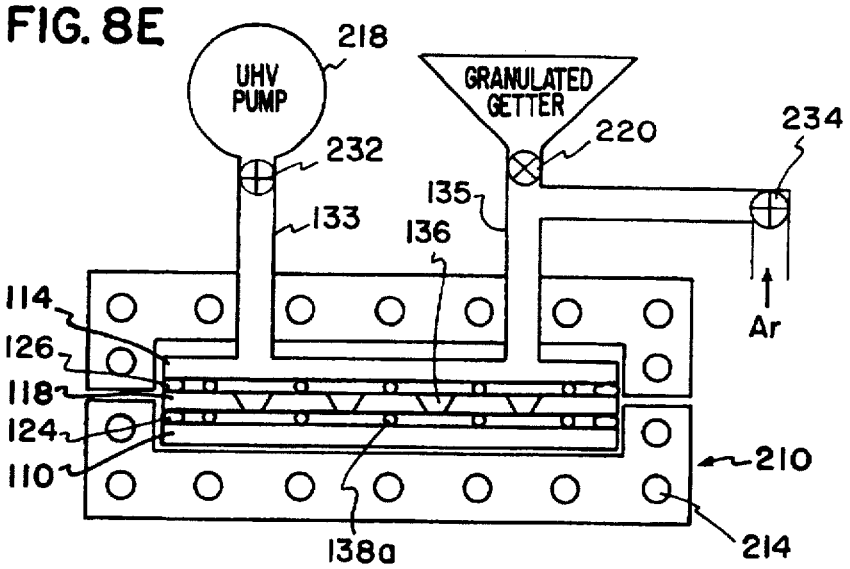

Accordingly, with the cathode plate 118 properly aligned over the anode plate 110 as shown in FIG. **8*b*, the backing plate 114, having sleeves (or tubes) 133 and 135 aligned with orifices (132 and 134 of FIG. 2), is located over previously disposed seals 126 and spacers 138*b*. The sealing fixture 210 is then closed (FIG. 8*d*). The backing plate 114 can be constructed of the same conventional material as the anode plate 110**.

Next, an inert gas (e.g., Argon) is injected through the tube 135, with the tube 133 shut off using a valve (232 of FIG. **8*e*) to ensure that the gas flows throughout the inside of the assembled structure. Simultaneous with the application of the gas, heat and pressure is applied to the two halves of the sealing fixture 210 to set the seals 124 and 126**. The Argon gas is used to purge the assembly of reactive gases, such as Nitorgen and Oxygen, and to maintain an equilibrium pressure between the walls of the heated plates.

An external UHV pump 218 (FIG. **8*e*) is next connected to the tube 133 to pump out the inert gas and to create a vacuum inside the structure (a valve 234 (FIG. 8*e*) in the tube 135 can be closed at this time). The circuit on the cathode pate 118 is then energized to clean (or decontaminate) the anode plate 110**.

As shown in FIG. **8*d*, a granulated getter 220 is then injected through the tube 135 and into the area between the cathode plate 118 and the backing plate 114. By using getter in the form of granuals (or beads) 132 larger in diameter than largest opening of the apertures 136, the getter is controlled in the selected area to absorb the discharged molecules passing through the apertures 136. Further, by adding the getter at this point in the process (after decontamination), the risk of fully saturating the getter at start up is eliminated. During this getter-injection period, the cathode circuit can remain energized for decontamination at start up. With the vacuum applied and with the seals set, both tubes 133 and 135 are pinched off and permanently sealed as shown in FIG. 2**. Granulated getter with fire-retardant additive (lubricant or beads), such as ST707 CONSTANTAN, can be used to increase the stability of the getter in the event that it is inadvertently is exposed to oxygen during this assembly process.

As an alternative implementation of this manufacturing process, rather than using a granulated getter 220 (FIG. **8*e*), a solid getter can be used and applied to the backing plate 114 before the backing plate is applied with the tubes 133 and 135**. If desired, the solid getter can be temporarily masked, using chemicals, until after the decontamination process is completed.

Figure 9:
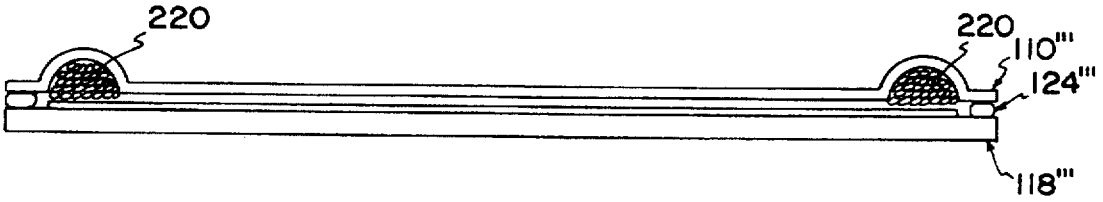
FIG. 9 is a side view of dual plate arrangement, in accordance with the principles of the present invention, which may be used as an alternative to the arrangement depicted in FIG. 3.

FIG. 9 shows a side view of a dual plate arrangement, which can be used as an alternative to the arrangement depicted in FIG. 3 and which can be manufactured using a similarly constructed sealing fixture 210 (FIGS. **8*a*–8*e*). As with the implementation discussed in connection with FIG. 8*e*, granual getter 220 can also be added after sealing and decontamination by forming channels 230 under the tubes 133 and 135 and injecting the granulated getter through both tubes 133 and 135**.

Accordingly, the present invention provides, inter alia, a field emission display structure and manufacturing process which permits ex-situ (out-of-vacuum) assembly, and, therefore, a mass-produceable (robotically) manufactured display structure.

Those skilled in the art will readily recognize that these and various other modifications and changes may be made to the present invention without strictly following the exemplary embodiments and applications illustrated and described herein, without departing from the true spirit and scope of the present invention which is set forth in the following claims.

What is claimed is:

1. A vacuum-sealed field emission type display, comprising: an anode plate having pixels for displaying images;

a backing structure;

a circuit-supporting substrate plate, forming a cathode structure, secured between the anode plate and the backing structure, having electron-emitters directed toward the anode plate;

a pump means arranged between the backing structure and the substrate plate for permanently absorbing gas molecules generated within the display; and the substrate plate having a multitude of pass-through apertures, each aperture surrounded by at least one side wall having a first section adjacent the circuit-supporting substrate plate and defining a first cross-sectional area and having a second section adjacent the first section and defining a second cross-sectional area that is substantially greater than the first cross-sectional area.

2. A vacuum-sealed field emission type display, according to claim 1, wherein the side wall surrounding each aperture is constructed and arranged to increase the passage of molecules through the substrate plate toward the pumping means without contacting the side wall.

3. A vacuum-sealed field emission type display, according to claim 1, wherein each aperture is conically shaped.

4. A vacuum-sealed field emission type display, according to claim 3, wherein each conically shaped aperture has an opening angle sufficient to permit gas molecules to pass through the substrate plate without contacting the side wall.

5. A vacuum-sealed field emission type display, according to claim 1, wherein the substrate plate is a photo-sensitive material.

6. A vacuum-sealed field emission type display, according to claim 1, wherein the circuit-supporting substrate plate includes rows of conductors, and wherein the apertures are located between the conductors and are elongated along the direction of the rows of the conductors.

7. A vacuum-sealed field emission type display, according to claim 1, wherein the pixels are grouped in sets and wherein the apertures are uniformly located opposite each set of pixels.

8. A field emission type display structure, according to claim 1, wherein the material for permanently absorbing gas molecules is getter.

9. A field emission type display structure, according to claim 8, wherein the getter is in granuals.

10. A field emission type display structure, according to claim 9, wherein the getter granuals are constructed so that they are larger in size than the second cross-sectional area.

11. A field emission type display structure, comprising:

an anode plate including an anterior side and a posterior side, the posterior side having a pixel arrangement for displaying images for viewing on the anterior side;

a circuit-supporting substrate plate, forming a cathode structure, having a first side and having a second side facing away from the anode plate, the substrate plate having a plurality of apertures arranged through the substrate plate from the first side through to the second side, each aperture having a conical shape to increase the passage of molecules through the substrate plate toward the pumping means without contacting the side wall, and having electron-emitters directed toward the posterior side of the anode plate;

a material for permanently absorbing gas molecules generated within the display;

a backing structure having an inner side to which the material is secured;

a first periphery seal securing the anode plate a selected distance from the substrate plate;

a second periphery seal securing the substrate plate a selected distance from the backing structure; and the first and second periphery seals forming a vacuum seal around an area, that includes the plurality of apertures arranged through the substrate plate, bordered by the anode plate and the backing structure.

12. A field emission type display structure, according to claim 11, wherein the material for permanently absorbing gas molecules is granual getter.

* * * * *